US007330160B1

(12) United States Patent
Fleming et al.

(10) Patent No.: US 7,330,160 B1
(45) Date of Patent: Feb. 12, 2008

(54) SUPPORT APPARATUS FOR A REFLECTOR

(75) Inventors: Matthew C. Fleming, Antioch, CA (US); John B. Lugten, Walnut Creek, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 11/506,461

(22) Filed: Aug. 18, 2006

(51) Int. Cl.
*H01Q 1/12* (2006.01)

(52) U.S. Cl. ..... 343/878; 343/912

(58) Field of Classification Search ..... 343/878, 343/880, 882, 840, 912, 915
See application file for complete search history.

(56) References Cited

U.S. PATENT DOCUMENTS 3,351,947 A * 11/1967 Hart ..... 343/840
4,672,389 A * 6/1987 Ulry ..... 343/915
4,689,637 A * 8/1987 Ochiai et al. ..... 343/914
5,532,710 A * 7/1996 Rodeffer ..... 343/912
6,323,827 B1 * 11/2001 Gilger et al. ..... 343/915
6,987,492 B1 1/2006 Buchanan et al.

* cited by examiner

*Primary Examiner*—Hoang V. Nguyen
(74) *Attorney, Agent, or Firm*—Michaelson & Associates; Peter L. Michaelson; George Wolken, Jr.

(57) ABSTRACT

The present invention relates to a support structure, system and materials for supporting a reflector. A rim stiffening beam is securely attached to the circumference of the reflector. A plurality of support struts is attached to the rim stiffening beam, joining to one or more nodes, thereby providing support for the reflector and substantial open volume directly behind the reflector for instrumentation, drive and control units, or other purposes. A central support structure supports the nodes and further supports a plate attached to the back of said reflector. This plate is advantageously relatively stiff in its radial dimension but relatively flexible in its axial dimension.

4 Claims, 5 Drawing Sheets

SUPPORT APPARATUS FOR A REFLECTOR

FIELD OF THE INVENTION

The present invention generally relates to the support and mounting of a dish-shaped reflector. More specifically, the present invention relates to the support and mounting of a one-piece dish-shaped reflector as typically used in connection with a radio telescope system.

Financial support from the SETI Institute, made possible by the Paul G. Allen foundation, is gratefully acknowledged.

BACKGROUND OF THE INVENTION

Large reflectors have been used for many years for the collection and concentration of electromagnetic radiation. This arrangement has been used in diverse fields such as optical astronomy, radio astronomy, as well as voice and data communications. In the case of radio astronomy, there is a practical limit on the diameter and size of the reflector that can be used to collect and analyze electromagnetic radiation in the radio frequency portion of the spectrum. The size is limited by such considerations as the diameter of the reflector, the weight of the reflector, the requirement to accurately position the reflector to investigate different portions of the sky, among other considerations. Even with these practical considerations and limitations, there is a strong desire to be able to collect data from ever larger sections of the sky and with increased accuracy. This desire has been a driving force in several technological advances including, for example, the development of phased arrays of relatively small reflectors. In this arrangement, a number of smaller reflectors are carefully positioned and coordinated to collect data from a section of the sky. The data collected by each relatively small reflector is computationally combined to generate an aggregated signal that is equivalent to a signal that would have required a single reflector with a much larger effective diameter to collect.

Even when using a phased array of smaller reflectors, performance is improved if the smaller reflectors are made as large as is feasible while still permitting the reflector to be positioned with great accuracy. In addition, it is advantageous if each smaller reflector can scan a substantial portion of the available sky. Furthermore, a smooth, uniform curvature for the dish reflector helps reduce signal distortion due to imperfections, seams, or variations in the curvature of the surface. Finally, it is important that reflector be stable and maintain its alignment during periods of high wind forces.

Radio telescope dish reflectors often comprise smaller segments that form the reflector, typically arranged so as to form a parabolic shape. The reflector is typically supported by a complex network of struts, braces, and support members to help ensure that the reflector maintains its shape as well to connect the reflector to the drive mechanisms that move and position the reflector. Such support arrangements typically add weight and complexity to the overall system design. The accuracy of the reflector's alignment is influenced by several factors such as deflection of the support structure due to gravitational forces, torsional and shear forces due to the differences in the thermal expansion characteristics of the various materials, torsional and shear forces due to the interaction of the reflector with wind, as well as other considerations. These factors are often addressed by design techniques such as increasing the size and strength of the support, incorporating complexity into the drive mechanism, decreasing the size of the reflector, and the like.

Thus, a need exists in the art for an improved support and mounting apparatus for maintaining the positioning accuracy of a reflector system, maintaining the shape of the dish reflector, decreasing the weight of the system, decreasing the size of the system, enhancing the resistance to wind forces, and/or other improvements.

BRIEF SUMMARY OF THE INVENTION

Accordingly and advantageously, the present invention relates to a dish-shaped reflector support system. In some embodiments of the present invention, the reflector is formed from one or more thin sheets of metal. A rim stiffener made from the same material as the reflector may be welded around the rim of the reflector to form a rim stiffener beam around the outside edge of the reflector. The reflector may be supported at the rim by a series of struts. The struts typically extend back to one or more nodes on a central frame. The central frame can also provide support to a flexible plate fastened behind the center of the reflector. The flexible plate can provide firm radial and torsional support but is advantageously axially flexible allowing the strut system to provide substantially all required axial support to the reflector at the rim. This design allows for a large open area behind the reflector, so that azimuth and elevation bearing systems can be located close to the reflector vertex. This location advantageously allows for smaller loads and fewer structural requirements placed upon the pedestal and drive systems to facilitate resistance to wind loading.

BRIEF DESCRIPTION OF THE DRAWINGS

To facilitate understanding, identical reference numerals have been used, where possible, to designate identical elements that are common to the figures. The drawings are not to scale and the relative dimensions of various elements in the drawings are depicted schematically and not to scale.

Other aspects, embodiments and advantages of the invention will become apparent upon reading the detailed description of the invention and the appended claims provided below, and upon reference to the drawings in which:

DETAILED DESCRIPTION OF THE INVENTION

Figure 1:
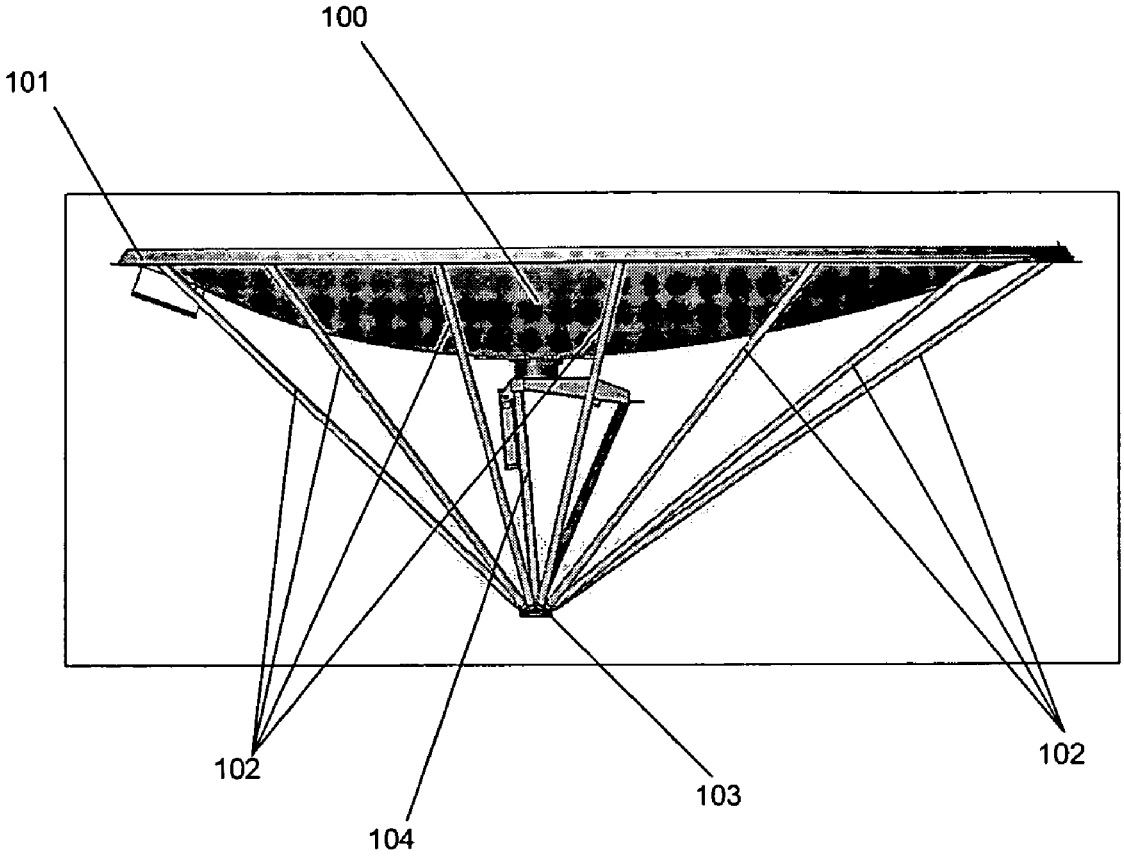
FIG. 1 depicts in side view typical radial struts and central mount.

Accordingly and advantageously, the present invention relates to a reflector support system, typically as utilized with a dish-shaped reflector. To be concrete in our discussion, we will describe in detail the application of the present invention to supporting a dish-shaped reflector as typically used in radio astronomy to collect distant signals. However, the present invention is not limited to radio astronomy and can be used to support dish-shaped reflectors for other purposes including, but not limited to, reception of satellite or other signals, and also in the support of beam-shaping reflectors used in signal transmission. The term "dish shaped" as used herein is not limited to a particular shape such as paraboloid, but includes other shapes that are or might be used as reflectors for the collection and/or transmission of electromagnetic radiation. The improved support structures as described herein can be advantageously employed with general "dish-shaped" reflectors, and is the sense used herein.

In some embodiments of the present invention, the reflector is formed from one or more thin sheets of metal. Advantageously, the reflector is formed from a single sheet of metal. As an example, the metal sheet may comprise aluminum and/or its alloys, steel and/or its alloys, metal composites, and the like. A rim stiffener, typically made from the same material as the reflector, is securely attached (typically by welding) around the rim of the reflector to form a rim stiffener beam (or simply "beam") around the outside edge of the reflector. Typical cross sectional shapes of the beam include triangular, rectangular, circular, elliptical, among others. Advantageously, the cross sectional shape is triangular. The reflector is typically supported at the rim by a series of struts. Advantageously, the struts are composed of the same material as the reflector so that there are no (or minimal) forces arising due to differences in thermal expansion characteristics. The struts typically extend back to one or more nodes on a central frame. The central frame also provides support to a plate fastened behind the center of the reflector. The plate provides firm radial and torsional support but is advantageously axially flexible. That is, the plate is reasonably stiff when distorted radially (in the direction from the central axis of the reflector towards its rim), or torsionally (rotationally about the reflector's central axis), but flexible in the axial direction (along the reflector's central axis). This plate structure ("flexible plate") thereby allows the strut system to provide essentially all required axial support to the reflector at the rim. This structure also allows for a large open area behind the reflector, so that various equipment can be installed close to the reflector's vertex, for example, azimuth and elevation bearing systems. This location allows smaller loads and less structural requirements being placed on the pedestal and drive systems in order to resist wind loading.

Figure 2:
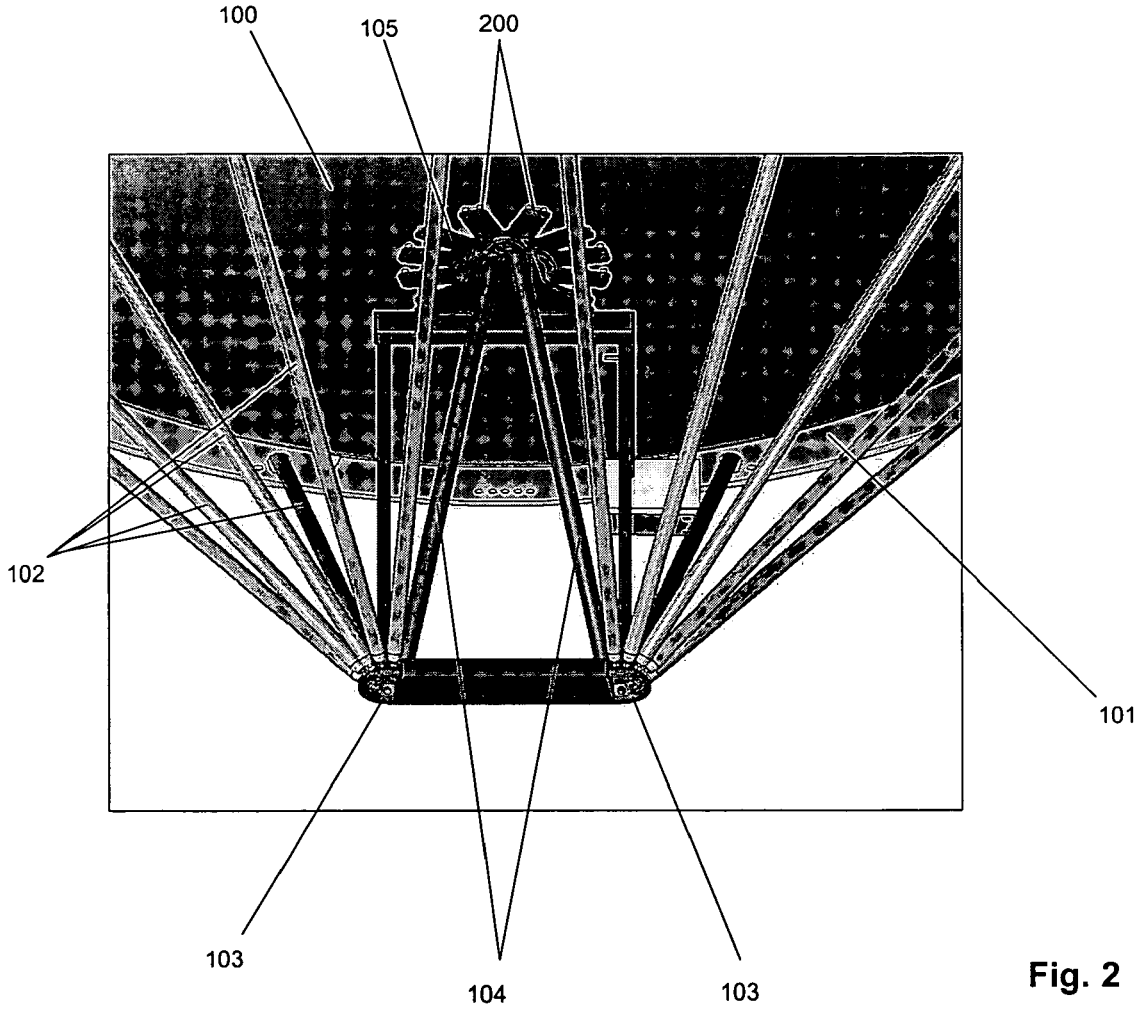
FIG. 2 depicts an enlarged view of radial struts and central mount according to some embodiments of the present invention.

Referring now to FIG. 1, and FIG. 2, a dish shaped reflector, 100, (as might be used with a radio telescope, for example), is advantageously formed from a single metal sheet comprising aluminum or its common alloys. A rim stiffener, 101, has been welded (or otherwise securely attached) around the rim of reflector 100 to form a rim stiffener beam (or "beam" in brief), typically having a triangular cross sectional shape. Advantageously, the rim stiffener is formed from the same material as the reflector. Support struts, 102, are connected to the rim stiffener beam and extend back to one or more nodes, 103, on a central frame, 104. Advantageously, the support struts are formed from the same material as the reflector and the rim stiffener. Central frame, 104, is typically comprised of a rigid material such as steel and the like. The central frame, 104, also provides axial support to a flexible plate, 105, fastened behind the center of the reflector (that is, "behind" denotes on the convex side of the reflector). This arrangement advantageously creates a large open area behind the reflector that may be used to house various components, such as the mechanical drive systems for elevation and azimuthal positioning.

A more detailed enlarged illustration is shown in FIG. 2. In this illustration, the support struts, 102, extend back to two nodes, 103. However, the number of nodes may be one or more. FIG. 2 also illustrates an embodiment of the attachment of the flexible plate, 105, to the back of reflector, 100. This embodiment illustrates the use of protrusions (or "fingers"), 200, emanating from a substantially contiguous central portion of the flexible plate to increase the axial flexibility while maintaining good radial and torsional stiffness. The required axial flexibility could also be achieved with attachment structures comprising a thin disk, a linear bearing on a large pin, as well as others.

Figure 3:
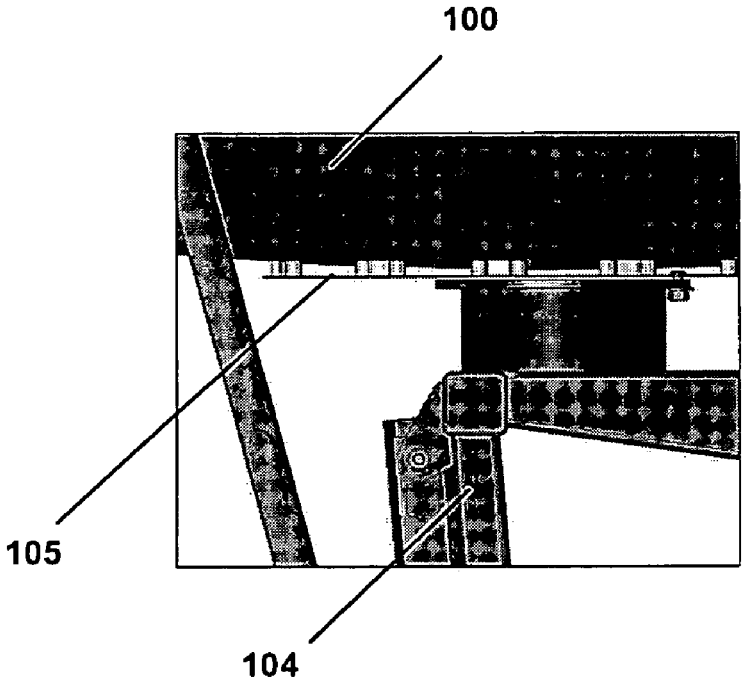
FIG. 3 depicts an enlarged view of the coupling of the central mount to the reflector according to some embodiments of the present invention.
Figure 4:
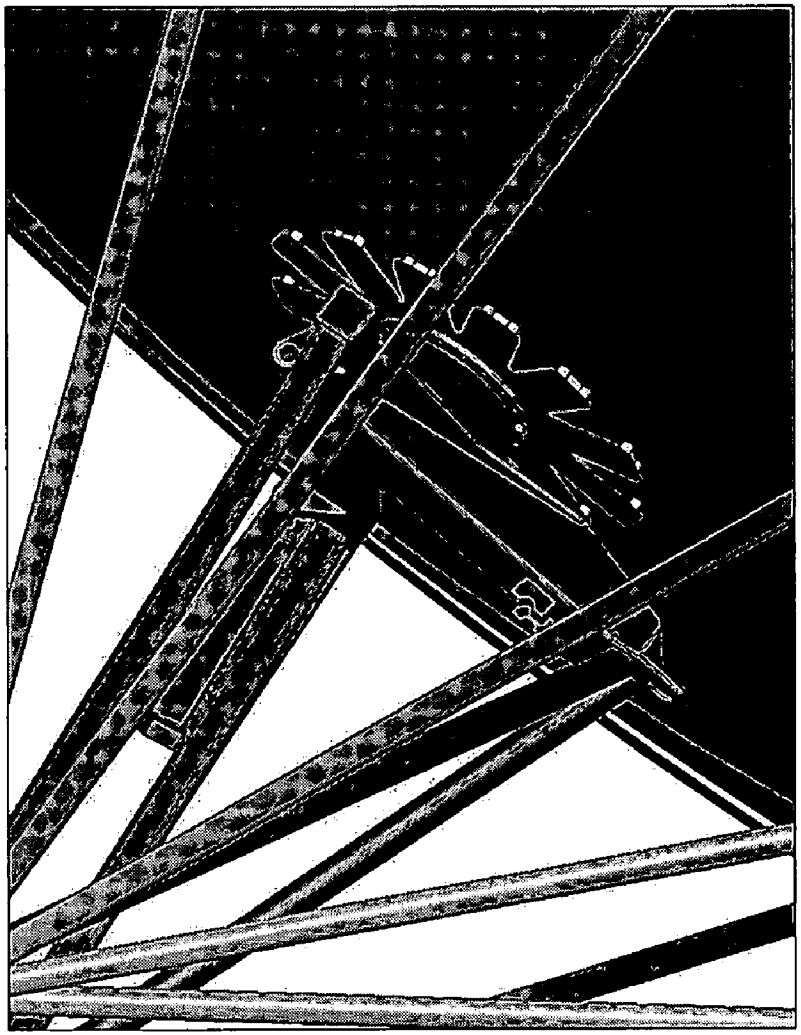
FIG. 4 depicts a perspective view of the coupling of the flexible plate to the back of the reflector.

FIG. 3 illustrates additional details regarding the coupling of flexible plate, 105, to the back of reflector, 100. Although the central frame, 104, and the reflector, 100, may be composed of different materials, the flexible plate, 105, serves to reduce or prevent distortion of the reflector due to differences in thermal expansion characteristics of the materials. Another perspective view of the coupling of the flexible plate to the back of the reflector is given in FIG. 4

Figure 5:
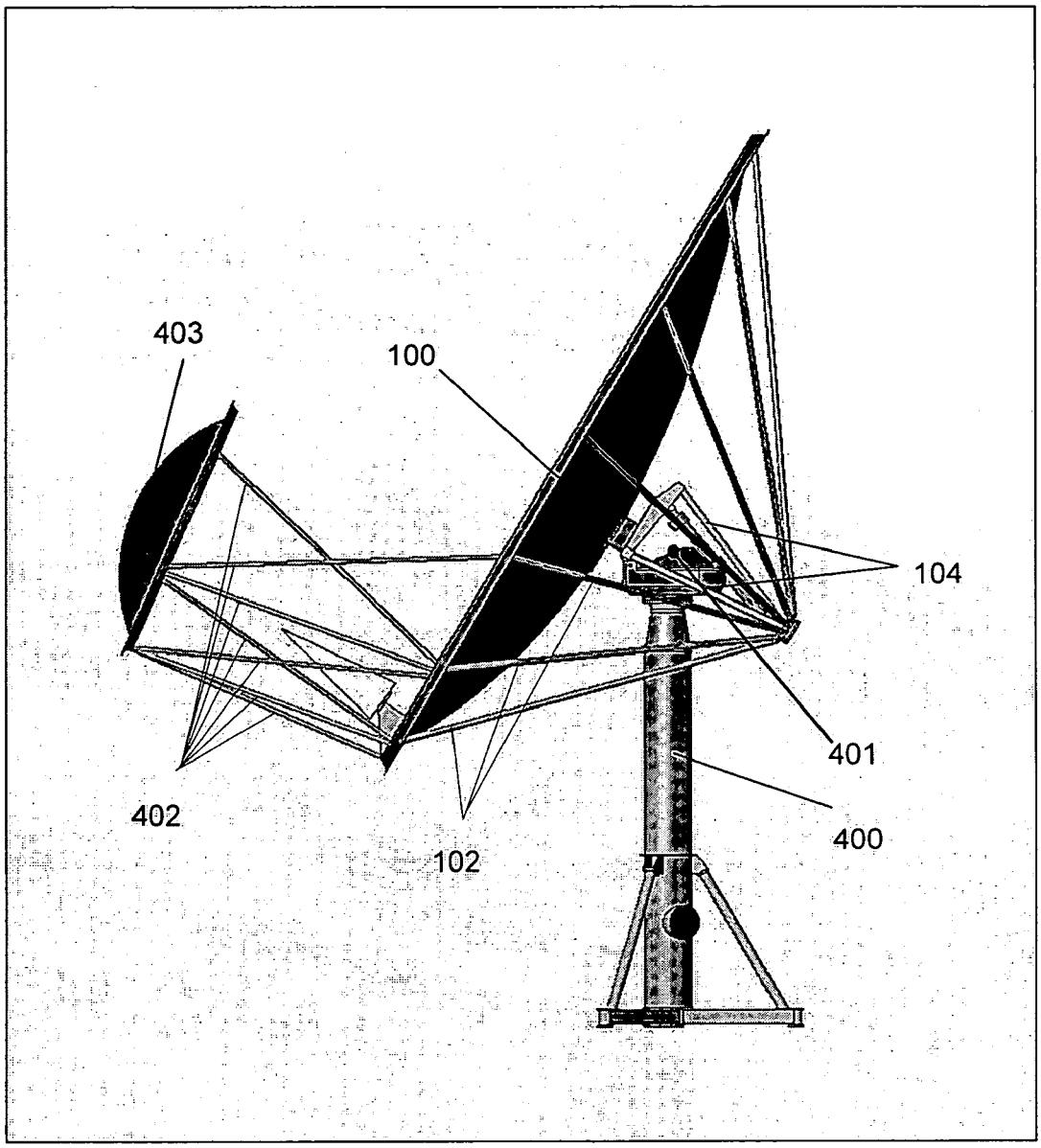
FIG. 5 depicts in side view a typical overall system according to some embodiments of the present invention.

FIG. 5 illustrates an embodiment of the present invention as applied to a radio telescope. Central frame, 104, is supported and positioned by a pedestal, 400. The large open area behind reflector, 100, allows the mechanical drive systems for elevation and azimuthal positioning, 401, to be located close to the vertex of the reflector. This location allows for smaller loads and less stringent structural requirements being placed upon the pedestal and drives in order to enable them to resist wind loading. This reflector support can be applied to both symmetric and offset optical designs. FIG. 5 illustrates an offset design. Support struts, 402, can be used to support the secondary reflector, 403, as well, but they are advantageously located opposite the reflector support struts, 102.

The foregoing descriptions of specific embodiments of the present invention have been presented for the purpose of illustration and description. They are not intended to be exhaustive or to limit the invention to the precise forms disclosed, and obviously many modifications, embodiments, and variations are possible in light of the above teaching.

What is claimed is:

1. An apparatus for supporting a reflector, comprising:

a rim stiffener attached to the edge of a reflector forming thereby a rim stiffening beam;

a plurality of support struts attached to said rim stiffening beam and extending to one or more nodes located behind said reflector; and, a central frame supporting said one or more nodes and further supporting an axially flexible plate attached to the back of said reflector.

2. The apparatus of claim 1 wherein said reflector, said rim stiffener, and said support struts are constructed from the same material wherein said material is aluminum, aluminum alloys, or combinations thereof.

3. The apparatus of claim 1 wherein said reflector is part of a radio telescope system.

4. The apparatus of claim 1 wherein the shape of said flexible plate comprises a contiguous central region with fingers protruding therefrom.

* * * * *